US007207144B2

(12) United States Patent
Shepard

(10) Patent No.: US 7,207,144 B2
(45) Date of Patent: Apr. 24, 2007

(54) DEVICE AND METHOD FOR AIDING INSTALLATION OF SUSPENDED CEILINGS

(76) Inventor: Dale Stuart Shepard, 14501 Barrett Mill Rd., Bainbridge, OH (US) 45612-9524

( * ) Notice: Subject to any disclaimer, the term of this patent is extended or adjusted under 35 U.S.C. 154(b) by 319 days.

(21) Appl. No.: 10/806,856

(22) Filed: Mar. 23, 2004

(65) Prior Publication Data

US 2005/0210805 A1 Sep. 29, 2005

(51) Int. Cl.
*E04B 2/00* (2006.01)

(52) U.S. Cl. ..... 52/506.05; 33/526; 33/645

(58) Field of Classification Search ..... 52/506.05; 33/645, 535, 562, 563, 566, 613, 526, 527
See application file for complete search history.

(56) References Cited

U.S. PATENT DOCUMENTS 3,456,702 A * 7/1969 Johnson ..... 269/41
4,043,689 A 8/1977 Spencer
4,624,088 A 11/1986 Arent
5,279,090 A * 1/1994 Yamaguchi et al. ..... 52/506.08
5,519,976 A 5/1996 Gee
5,611,185 A 3/1997 Wilz
5,619,833 A * 4/1997 Neff ..... 52/506.07
5,927,037 A 7/1999 Kinsella
5,979,134 A * 11/1999 Neff ..... 52/506.07
6,205,733 B1 3/2001 LaLonde
6,477,815 B2 11/2002 Paul
2002/0083669 A1 7/2002 Paul
2003/0200719 A1 10/2003 Koski

FOREIGN PATENT DOCUMENTS

DE 3420406 10/1985
GB 8510637 12/1985

* cited by examiner

*Primary Examiner*—Richard E. Chilcot, Jr.
*Assistant Examiner*—Lindsay M. Maguire
(74) *Attorney, Agent, or Firm*—R. William Graham

(57) ABSTRACT

A device for aiding installation of suspended ceilings includes a first cross member having an upper face to be disposed adjacent a bottom face of a main-tee and a second cross member extending from the first cross member at 90° and having a an upper face to be disposed adjacent a bottom face of a cross-tee. The first cross member has an upwardly extending retention lip having a slot formed therein to frictional receive a portion of the main-tee in a manner to retain the device thereagainst. The second cross member has an upwardly extending guide lip which in conjunction with the adjacent upper face provides an abutment against which the cross-tee may be disposed such that the cross-tee is at 90° to the main-tee thereby enabling easy permanent riveting of the tee to the wall angle. A method of installing a ceiling grid is also provided.

7 Claims, 5 Drawing Sheets

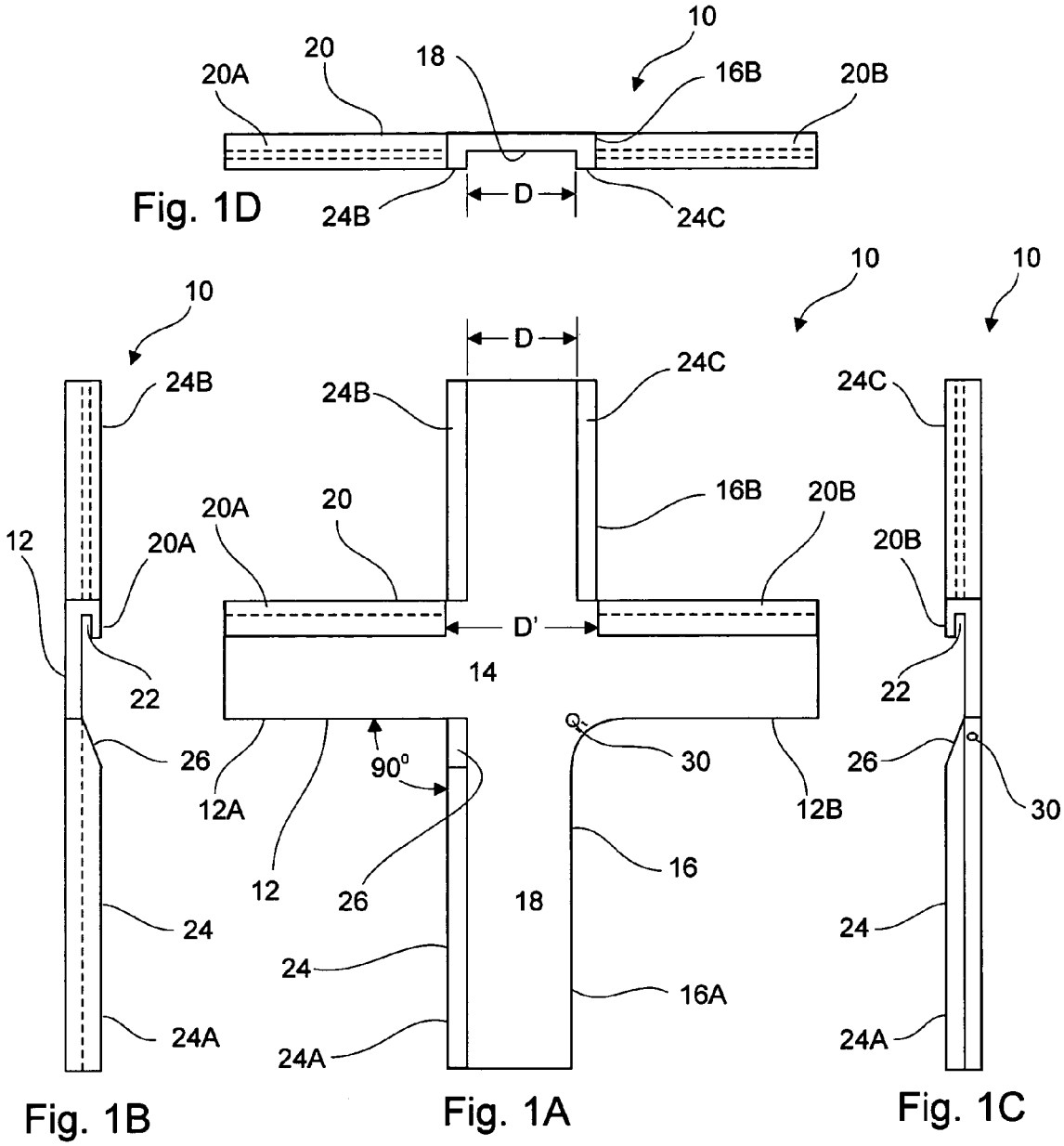
Fig. 1D
Fig. 1B
Fig. 1A
Fig. 1C
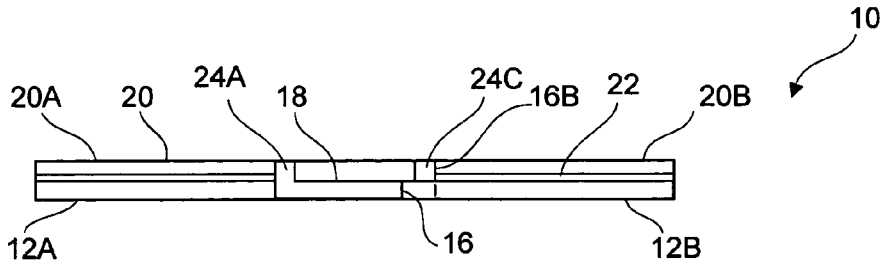
Fig. 1E

DEVICE AND METHOD FOR AIDING INSTALLATION OF SUSPENDED CEILINGS

BACKGROUND OF THE INVENTION

1. Field of the Invention

The present invention relates to a device for aiding installation of suspended ceilings. More particularly, the invention is directed to a tool for use during ceiling grid installation which offers a faster and more accurate means of aligning cross-tee and main-tee ends into wall angle.

2. Related Art

As previously described and understood, the most common technique of installing a suspended acoustical ceiling, whether installed in a commercial building, or in a residential basement, is to suspend the ceiling grid under the joist supports with providing accessibility to mechanical equipment, plumbing electric, etc. These grids are typically installed level and at 90° angles to perimeter walls/partitions, but occasionally for building constraints or aesthetics are installed at acute angles, for example, such ceilings as a cathedral, sloped, diagonal, or free floating unattached to perimeter walls (to accent a small section of a large room such as over a grocery kiosk).

In a typical suspension ceiling grid using 2×4 foot ceiling tiles, so-called "main-tees" are portions of the grid spaced on four foot centers and "four foot cross-tees" are spaced on two foot centers. The main-tees and cross-tees are intended to be interlocked in straight lines at 90° angles to create a 2×4 foot rectangular grid to receive and hold finish components such as ceiling tile, lights, hvac diffusers, etc. Other grids require 2×2 foot tile, etc., and in such case two foot cross-tees are perpendicularly interlocked in center slots of the four foot cross-tees. The main-tees are suspended by hanger wires looped through provided holes in main-tee together with the wall angle which is secured to the wall, which together support the cross-tees and all other finish components.

Typically, the sequence of installation begins with establishing a grid lay-out and a finish elevation. Lay-out determines the direction of the main-tees and cross-tees taking into consideration such things as desired location of lights, hvac diffusers, etc. Elevation is often determined by height of plumbing pipes, ductwork etc. above.

Commercially, architectural drawings are usually supplied and the room need only be measured to mark locations of main-tees and cross-tees and to verify that prescribed elevation will provide clearance of all other work above. Once lay-out is completed, hanger wires are installed on four foot centers in line with main-tees by attaching to structural members above such as joists, beams, or decking etc. and wall angle is fastened to perimeter walls/partitions. Laser levels (or optionally water levels, strings, and chalk lines) are commonly used for leveling of wall angle and main-tees.

A corner of the room is usually designated as a starting point. Two perpendicular string lines are stretched along the two adjacent walls, one in position of the first main-tee, and the other at a 90° angle in line with the first row of cross-tees. One end of the first row of main-tees is trimmed such that when a cut end is placed in the wall angle, a tee slot is on the first cross-tee line. Cross-tees are cut to measurement of inside wall angle to the main string line such that when interlocked to the main-tee with the cut end in wall angle, the first main-tee is in position on the first main string line.

The first main-tee is trimmed accordingly and suspended level by hanger wires with cut end temporarily clamped to wall angle to position properly on both the main string line and a tee slot on the cross-tee string line. Then starting at the slot on the first cross-tee string line and continuing every two foot, cross-tees are cut and interlocked to main-tee with cut edge temporarily clamped to wall angle so as main lines up on first main border line. A second main is then trimmed and suspended in the same manner temporarily clamped in place to the wall angle with a tee slot on the cross-tee line. Four foot cross-tees are interlocked in established cross-tee slots between the two mains.

Both diagonal measurements of a full space are then checked to see if the grid is square (a term used in the industry for 90° angles applied to rectangles, as well as squares). If out of square, the grid must be shifted off one line or the other until square. If shifted, string lines are then adjusted to the grid's new location.

Main-tees are then again checked for level to laser light, and hanger wires are tied off at main-tees. Cross-tee and main-tee ends must then be squared/aligned into permanent position and riveted to wall angle. This process is typically done by sighting for straight as locations of cross-tees cannot simply be measured and marked on wall mold as grid systems are of nominal size and spacing is not in equal full inch increments, therefore calculations must be made to measure. This is time consuming yet performed in the art. Some use a string line to be tied to a clip on opposite sides of a room, and then move the clips down the walls. With regard to squaring main-tee and cross-tee ends, it is impracticable as it would require installer to travel back and forth from one side of the room to the other to move lines, and if the room doesn't have straight walls, the strings knots must continually be retied, these procedures take too much time. This procedure in reference to leveling grid is no longer preferred with the advent of construction lasers. The remainder of the grid is filled in from each string line away to an opposite wall. Subsequent to installation of lights, hvac equip, etc. and inspections, ceiling tile is installed by first cutting borders to fit smaller non uniform grid areas, and then laying in the full tile.

There thus remains a need to improve the method and device for installing suspended ceilings.

SUMMARY OF THE INVENTION

It is an object to improve suspended ceilings.

It is another object to ease the installation of suspended ceilings.

It is another object to provide a device for aiding installation of suspended ceilings.

It is another object to provide a faster and more accurate means to square/align cross-tee and main-tee ends into wall angle of suspended ceiling.

Accordingly, the invention is directed to a device for aiding installation of suspended ceilings. The device includes a first cross member having an upper face to be disposed adjacent a bottom face of a main-tee and a second cross member extending from the first cross member at 90° and having a an upper face to be disposed adjacent a bottom face of a cross-tee. The first cross member has an upwardly extending retention lip having a slot formed therein, wherein the slot is of width to frictional receive a portion of the main-tee in a manner to temporarily retain the device thereagainst with upper face held in place against the bottom face of the main-tee. The second cross member has an upwardly extending guide lip which when the retention lip is connected to the main-tee, the guide lip in conjunction with the adjacent upper face provides an abutment against which the cross-tee can be disposed with the bottom face of the cross-tee facing the upper face of the second cross member such that the cross-tee is at 90° to the main-tee thereby enabling easy permanent riveting of the tees to wall angle together, and wherein once the cross-tee is so connected to the main-tee to form a permanent cross structure portion of the grid, the device is configured to be removed from the permanent cross structure portion.

In one embodiment, the first cross member includes one arm and the second cross member includes one arm. In another embodiment, the first cross member includes two arms and the second cross member includes one arm which is disposed between the two arms, each arm first cross member having a retention lip. In yet another embodiment, the first cross member includes two arms and the second cross member includes two arms which are aligned and disposed between aligned arms of the first cross member. Each arm of the first cross member can have a retention lip and each arm of the second cross member can have a guide lip. Preferably, the retention lips are oriented on a common edge of the first cross member and the guide lips are likewise oriented on a common edge of the second cross member.

The device can also include an eyelet proximate a 90° of the cross members to which a string can be attached. A method for aiding installing a suspended ceiling grid which uses main-tee and cross-tee construction is provided. The method includes the steps of (a) removably friction fit connecting a squaring device to a flange of main-tee, the device having means for supporting and maintaining a cross-tee to be connected to the main-tee at 90° thereto the cross-tee and the main-tee forming a cross structure portion of the grid (b) permanently connecting the cross-tee to a main wall angle while held at 90° with respect to one another with the aid of the device, and (c) removing the device from the cross structure portion.

The invention replaces all current methods of cross-tee alignment as a faster and more accurate means. Other applications will be appreciated by the installer such as a faster means of attaching a string line directly to grid intersections anywhere in the ceiling to align any portion of the grid. Other objects and advantages will be readily apparent to those skilled in the art upon viewing the drawings and reading the detailed description hereafter.

BRIEF DESCRIPTION OF THE DRAWINGS

FIG. 1A is a front view of an embodiment of the present invention.

FIG. 1B is a side view of FIG. 1A taken from the left.

FIG. 1C is a side view of FIG. 1A taken from the right.

FIG. 1D is a top view of FIG. 1A.

FIG. 1E is a bottom view of FIG. 1A.

DETAILED DESCRIPTION OF THE INVENTION

Figure 2D:
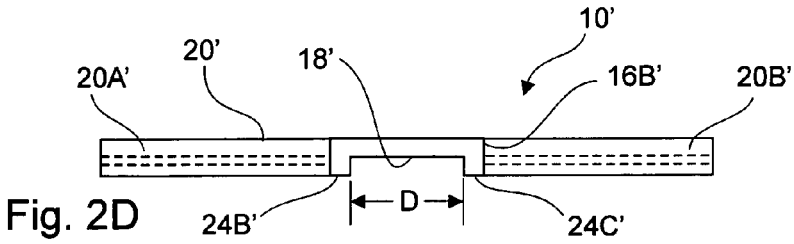
FIG. 2D is a top view of FIG. 2A.
Figures 2A, 2B, 2C:
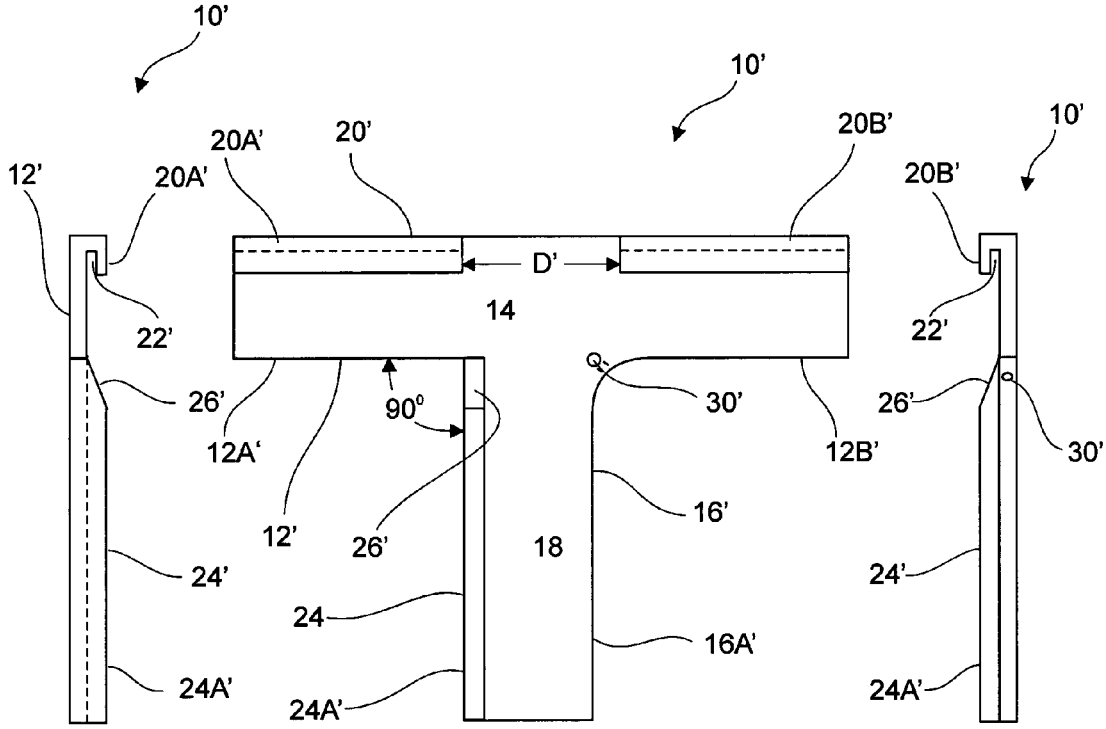
FIG. 2A is a front view of another embodiment of the present invention.
FIG. 2B is a side view of FIG. 2A taken from the left.
FIG. 2C is a side view of FIG. 2A taken from the right.
Figure 2E:
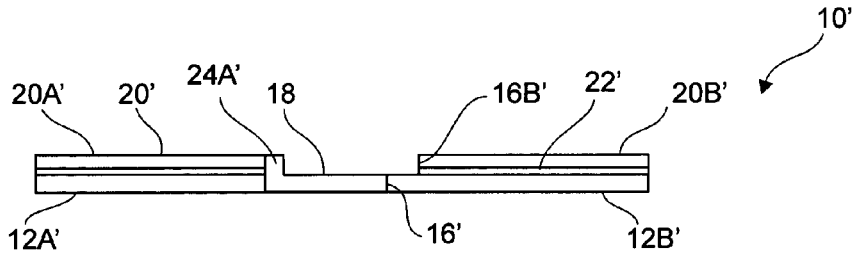
FIG. 2E is a bottom view of FIG. 2A.
Figure 3D:
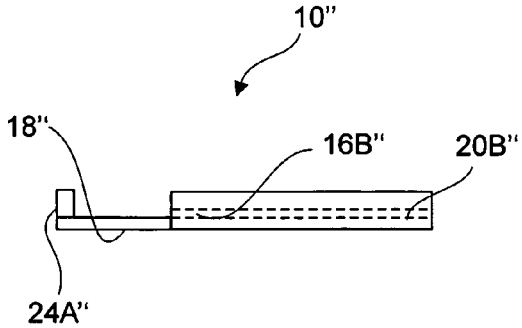
FIG. 3D is a top view of FIG. 3A.
Figure 3B:
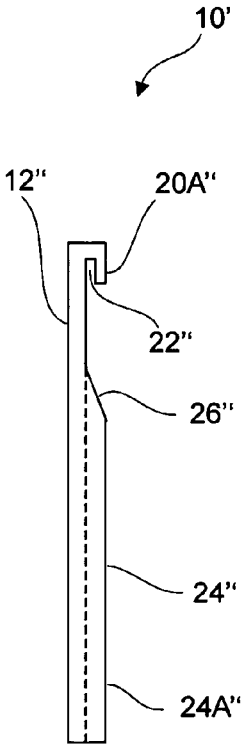
FIG. 3B is a side view of FIG. 3A taken from the left.
Figure 3A:
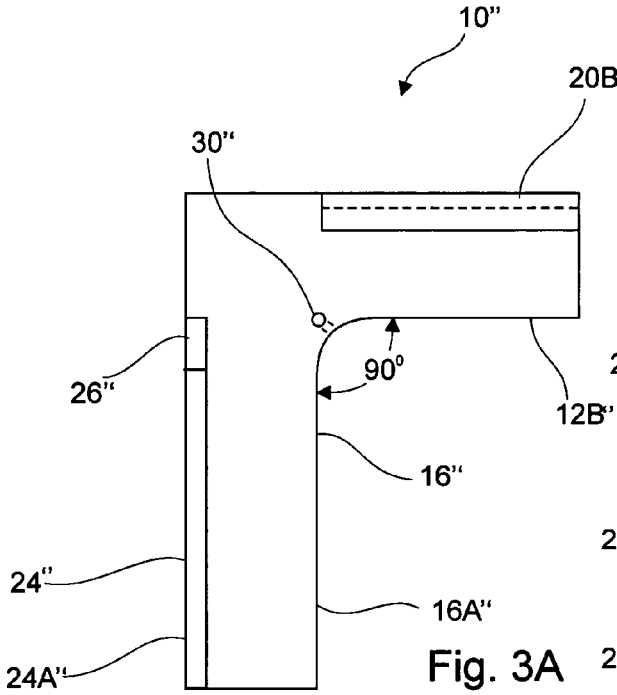
FIG. 3A is a front view of yet another embodiment of the present invention.
Figure 3C:
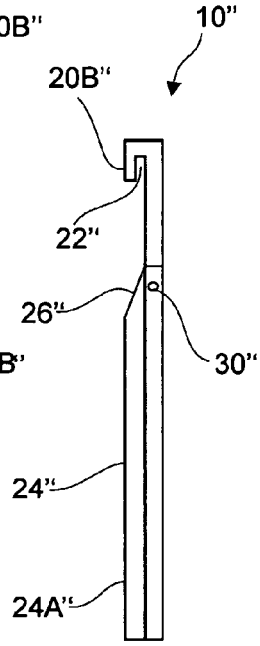
FIG. 3C is a side view of FIG. 3A taken from the right.
Figure 3E:
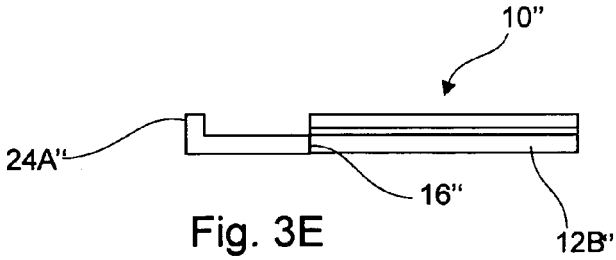
FIG. 3E is a bottom view of FIG. 3A.
Figure 4A:
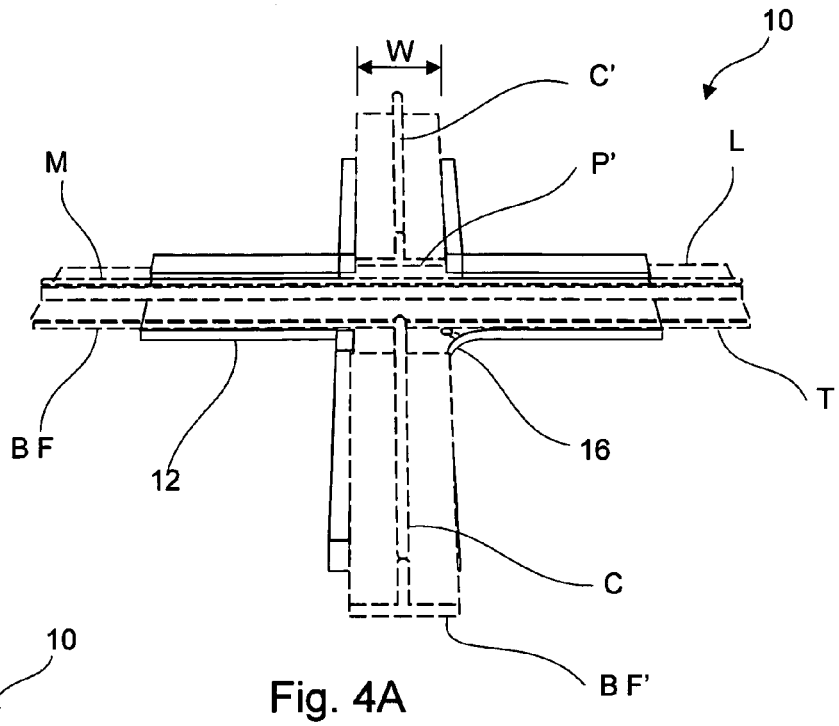
FIG. 4A is a perspective of showing the embodiment in FIG. 1A in use.
Figure 4B:
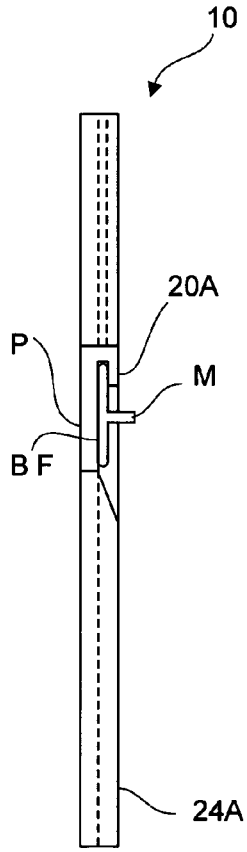
FIG. 4B is a side view of FIG. 4A taken from the left.
Figure 4C:
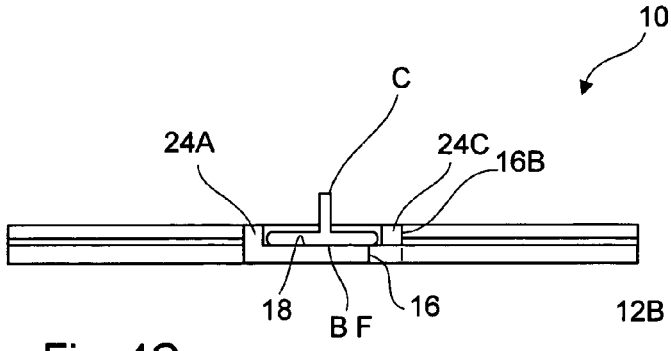
FIG. 4C is a bottom view of FIG. 4A.
Figure 5:
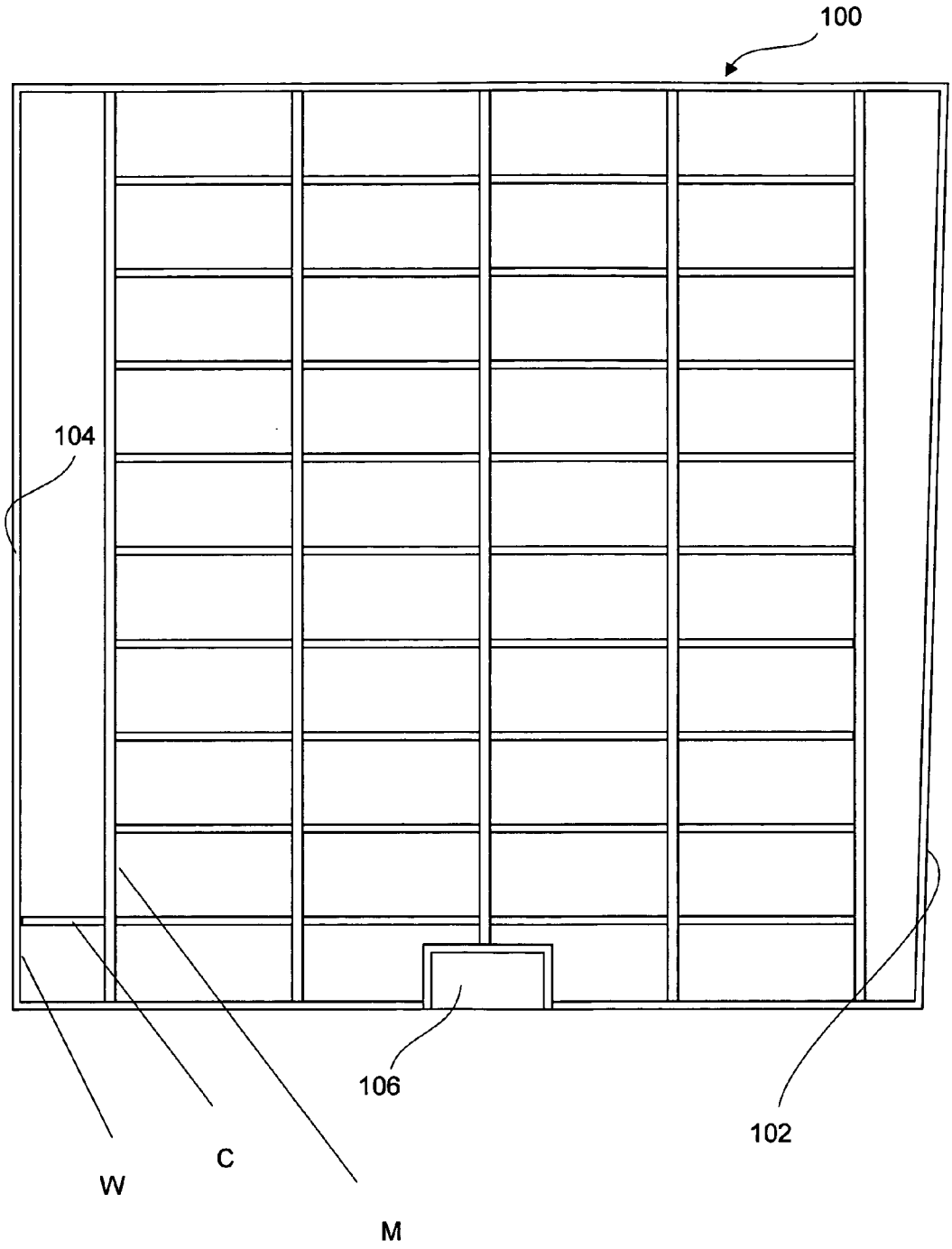
FIG. 5 depicts a typical grid of a suspended ceiling.

Referring now to the drawings, a device for aiding installation of suspended ceilings is generally represented by the numbers 10, 10' and 10". A typical ceiling grid 100 is shown in FIG. 5, which is depicted with two sides 102 (tapered) and side 104 being the starter side to run square until reaching side 102. A portion 106 represents a typical cutout for a duct, window or other obstruction.

Referring to FIGS. 1A–1E and 4, the device 10 includes a first cross member 12 having an upper face 14 to be disposed adjacent a bottom face BF of a main-tee M and a second cross member 16 extending from the first cross member at 90° and having a an upper face 18 to be disposed a bottom face BF' of a cross-tee C. The first cross member 12 has an upwardly extending retention lip 20 having a slot 22 formed therein, wherein the slot 22 is of width to frictional receive a facial portion P of the main-tee M in a manner to retain the device 10 thereagainst with upper face 14 held in place against the bottom face BF of the main-tee M. In this regard, the retention lip 20 provides for a friction type snap-fit about portion P.

The second cross member 16 has an upwardly extending guide lip 24 which runs along the edge of the cross member 16 and has a tapered end 26. When the retention lip 20 is connected to the main-tee M, the guide lip 24 in conjunction with the adjacent upper face 18 provides an abutment against which the cross-tee C may be disposed with the bottom face BF' of the cross-tee C facing the upper face 18 of the second cross member 16 such that the cross-tee C is at 90° to the main-tee M thereby enabling easy permanent riveting of the same together.

The first cross member 12 includes two co-aligned arms 12A and 12B and the second cross member 16 includes two co-aligned arms 16A and 16B which are preferably centrally disposed between aligned arms 12A and 12B of the first cross member 12. Each arm 12A and 12B of the first cross member 12 includes respective retention lip 20A and 20B and each arm 16A and 16B of the second cross member 16 includes respective guide lip 24A and 24B, guide lip 24A being shown with tapered end 26. Preferably, the retention lips 20A and 20B are oriented on a common edge of the first cross member 12 and the guide lips 24A and 24B are likewise oriented on a common edge of the second cross member 16. Additionally, arm 16B can include another guide lip 24C which is spaced from guide lip 24B a distance D which is greater than the width W of cross-tee C/C' (which is the same width for main-tee M) to receive cross-tee C' therebetween with bottom face BF' adjacent face 18. The device 10 can also include an eyelet 30 proximate a 90° connection of the cross members 12 and 16 to which a string (not shown) can be attached and used to align a portion of the "to be formed" grid 100.

Retention lips 20A and 20B are separated at least the distance D' which is at least the distance D. The tapered end 26 enables the device 10 to the main-tee M and cross-tee C' and with a trailing edge T of the main-tee M touching the tapered end 26 provide sufficient clearance for a leading edge L of main-tee M to be inserted into retention lip 20. Also, the guide lips 24B and 24C receive cross-tee C'. The device 10 then becomes self supporting and the guide lip 24A and face 18 provide the abutment for cross-tee C, wherein the same can be held in place for riveting with an assured 90° angle to main-tee M.

FIGS. 2A–2E show an alternative embodiment, wherein the first cross member 12' includes two arms 12A' and 12B' and the second cross member 16' includes one arm 16A' which is disposed between the two arms 12A' and 12B', each arm having a retention lip 20A' and 20B' and cross member 16A' having guide lip 24A' and tapered end 26'. FIGS. 3A–3E show still another embodiment wherein first cross member 12" includes one arm 12A" with retention lip 20A" and the second cross member 16" includes one arm 16A" with guide lip 24A" and end 26". These two embodiments can provide for special use applications in tights areas where the use of a larger number of arms is not feasible. The device 10, 10' and 10" can be machined from a solid piece of aluminum, or formed of ridged plastic.

A method for aiding installing a suspended ceiling grid which uses main-tee and cross-tee construction is provided. The method includes the steps of (a) removably connecting a squaring device e.g., 10 to a main-tee, the device having means (e.g., retention lip 20) for supporting and maintaining a cross-tee C to be connected to the main-tee M at 90° thereto and (b) permanently connecting the cross-tee C to a main wall angle W while held at 90° with respect to one another with the aid of the device 10.

The invention thus provides a novel device and method for forming a ceiling grid. The above described embodiments are set forth by way of example and are not for the purpose of limiting the present invention. It will be readily apparent to those skilled in the art that obvious modifications, derivations and variations can be made to the embodiment(s) without departing from the scope of the invention. Accordingly, the claims appended hereto should be read in their full scope including any such modifications, derivations and variations.

The invention claimed is:

1. A device for aiding installation of a suspended ceiling grid which uses main-tee and cross-tee construction, which includes:

a first cross member having an upper face to be disposed adjacent a bottom face of the main-tee and a second cross member extending from said first cross member at a predetermined angle and having a an upper face to be disposed adjacent a bottom face of the cross-tee, said first cross member having an upwardly extending retention lip having a slot formed therein, wherein said slot is of width to frictional receive a portion of said main-tee in a manner to temporarily retain said device thereagainst with said upper face held in place against the bottom face of the main-tee, said second cross member having an upwardly extending guide lip which when said retention lip is connected to the main-tee, said guide lip in conjunction with said adjacent upper face provides an abutment against which the cross-tee can be disposed with the bottom face of the cross-tee facing said upper face of said second cross member such that the cross-tee is at said predetermined angle to the main-tee thereby enabling easy permanent riveting of a main wall angle to said cross-tee together, and wherein once the cross-tee is so connected to the main-tee to form a permanent cross structure portion of said grid, said device is configured to be removed from said permanent cross structure portion.

2. The device for aiding installation of a suspended ceiling grid of claim 1, wherein said first cross member includes one arm and said second cross member includes one arm.

3. The device for aiding installation of a suspended ceiling grid of claim 1, wherein said first cross member includes two arms and said second cross member includes one arm which is disposed between said two arms of said first cross member, each said arm of said first cross member having a retention lip.

4. The device for aiding installation of a suspended ceiling grid of claim 1, wherein said first cross member includes two co-aligned arms and said second cross member includes two co-aligned arms which are disposed between said arms of said first cross member, wherein each said arm of said first cross member has a retention lip and each said arm of said second cross member has a guide lip.

5. The device for aiding installation of a suspended ceiling grid of claim 1, wherein said predetermined angle is 90°.

6. The device for aiding installation of a suspended ceiling grid of claim 5, wherein said device includes an eyelet proximate a 90° connection of said cross members to which a string can be attached.

7. A method for aiding installing a suspended ceiling grid which uses main-tee and cross-tee construction, which includes the steps of:

(a) removably friction fit connecting a squaring device to a flange of main-tee, said device having means for supporting and maintaining a cross-tee at 90° with respect to said main-tee said cross-tee and said main-tee forming a cross structure portion of said grid;

(b) permanently connecting said cross-tee to a main wall angle while held at 90° with respect to said wall angle and said main-tee with the aid of said device, and (c) removing said device from said cross structure portion.

* * * * *